US006788131B1

(12) United States Patent
Huang

(10) Patent No.: US 6,788,131 B1
(45) Date of Patent: Sep. 7, 2004

(54) BANDGAP CIRCUIT FOR GENERATING A REFERENCE VOLTAGE

(75) Inventor: Te-Hsun Huang, Hsinchu (TW)

(73) Assignee: Feature Integration Technology Inc., Hsinchu (TW)

( * ) Notice: Subject to any disclaimer, the term of this patent is extended or adjusted under 35 U.S.C. 154(b) by 0 days.

(21) Appl. No.: 10/437,933

(22) Filed: May 15, 2003

(51) Int. Cl.[7] ..... G05F 1/10
(52) U.S. Cl. ..... 327/539
(58) Field of Search ..... 327/124, 530, 327/534, 535, 537, 538, 539, 540, 541, 543, 545, 546

(56) References Cited

U.S. PATENT DOCUMENTS 6,275,098 B1 * 8/2001 Uehara et al. ..... 327/539

6,462,612 B1 * 10/2002 Roh et al. ..... 327/539

* cited by examiner

*Primary Examiner*—Jeffrey Zweizig
(74) *Attorney, Agent, or Firm*—Finnegan, Henderson, Farabow, Garrett & Dunner, L.L.P.

(57) ABSTRACT

A circuit for providing a reference voltage that includes a chopping circuit for generating a voltage level, a converter coupled to the chopping circuit for converting an input voltage into a digital output based on the voltage level, and generating a first output in a predetermined period, and a second output in a subsequent second predetermined period, a controller for controlling the chopping circuit such that the chopping circuit generates the voltage level in a same period as the predetermined period, a first register coupled to the converter for storing the first output, a second register coupled to the converter for storing the second output, and a combiner for combining the first and the second outputs.

20 Claims, 2 Drawing Sheets

BANDGAP CIRCUIT FOR GENERATING A REFERENCE VOLTAGE

DESCRIPTION OF THE INVENTION

1. Field of the Invention

This invention relates in general to a bandgap circuit and, more particularly, to a bandgap circuit for providing a reference voltage.

2. Background of the Invention

Bandgap circuits have conventionally been used to provide a reference voltage by which an input voltage is measured. An example of a conventional bandgap circuit is illustrated in FIG. 1.

Referring to FIG. 1, a bandgap circuit 10 generally includes a chopping circuit 12 for generating a voltage level, and a filter circuit 14 to filter out offset noises generated from an offset voltage in chopping circuit 12 as the result of asymmetric fabrication processes. Filter circuit 14 includes a resistor (R) coupled in parallel to a capacitor (C), both of which contribute to the relative large chip area occupied by conventional bandgap circuits. The trend in modem semiconductor processing, of course, if toward smaller chip size. This cannot be obtained with conventional filter circuit 14.

Bandgap circuit 10 may also include an operational amplifier 16 for amplifying a filtered voltage level. Operational amplifier 16 is coupled to an analog-to-digital converter ("CADCS") 18 that converts an analog input voltage $V_i$, controlled by the amplified voltage from operational amplifier 16, to a digital output at a predetermined frequency, for example, ranging from 1 KHz to 10 KHz. However, chopping circuit 12 generally includes metal-oxide-semiconductor ("MOS") switches (not shown) that operate at a high switching frequency, for example, 200 KHz. The discrepancy between the converter's working frequency and the MOS switch's switching frequency may result in "chopping noises" in the reference voltage provided by bandgap circuit 10.

SUMMARY OF THE INVENTION

Accordingly, the present invention is directed to a bandgap circuit that obviates one or more of the problems due to limitations and disadvantages of the related art.

To achieve these and other advantages, and in accordance with the purpose of the invention as embodied and broadly described, there is provided a circuit for providing a reference voltage that includes a chopping circuit for generating a voltage level, a converter coupled to the chopping circuit for converting an input voltage into a digital output based on the voltage level, and generating a first output in a predetermined period, and a second output in a subsequent second predetermined period, a controller for controlling the chopping circuit such that the chopping circuit generates the voltage level in a same period as the predetermined period, a first register coupled to the converter for storing the first output, a second register coupled to the converter for storing the second output, and a combiner for combining the first and the second outputs.

In one aspect, the controller provides a clock signal having a same period as the predetermined period to the chopping circuit.

In another aspect, the controller synchronizes the converter with the chopping circuit by providing a signal to initiate the converter.

Also in accordance with the present invention, there is provided a circuit for providing a reference voltage that includes a chopping circuit for generating a voltage level ($V_0$), an analog-to-digital converter coupled to the chopping circuit for converting an input voltage ($V_{in}$) into a digital out based on the voltage level, and generating a first output ($V_1$) of N bits in a first predetermined period, and a second output ($V_2$) of N bits in a subsequent second predetermined period, a controller for synchronizing the chopping circuit and the converter by providing a clock to the chopping circuit and simultaneously a signal to initiate the converter such that the chopping circuit generates the voltage level in a same period as the predetermined period, a first register coupled to the converter for storing the first output, a second register coupled to the converter for storing the second output, and a combiner for combining the first and the second outputs and providing the reference voltage.

Sill in accordance with the present invention, there is provided a method of providing a reference voltage that includes providing a chopping circuit, generating a voltage level through the chopping circuit, converting an input voltage into a digital form based on the voltage level, defining a first predetermined period, defining a second predetermined period, generating a first output of the input voltage in the first predetermined period, generating a second output of the input voltage in the second predetermined period, providing a clock to the chopping circuit, generating the voltage level in a same period as the first predetermined period, and combining the first and the second outputs to form the reference voltage.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the present embodiment of the invention, an example of which is illustrated in the accompanying drawings. Wherever possible, the same reference numbers will be used throughout the drawings to refer to the same or like parts.

Figure 1:
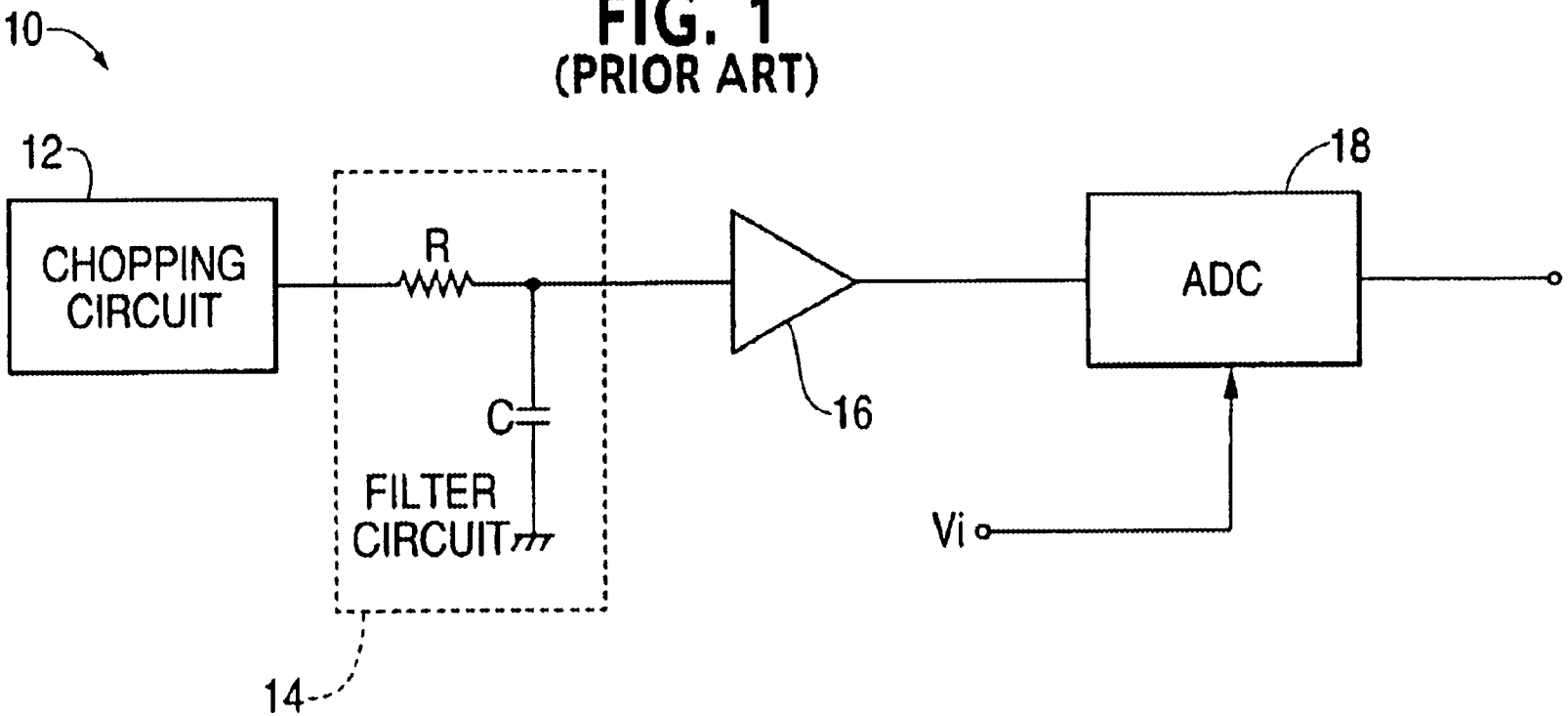
FIG. 1 (PRIOR ART)
FIG. 1 shows a schematic diagram of a conventional bandgap circuit.
Figure 2:
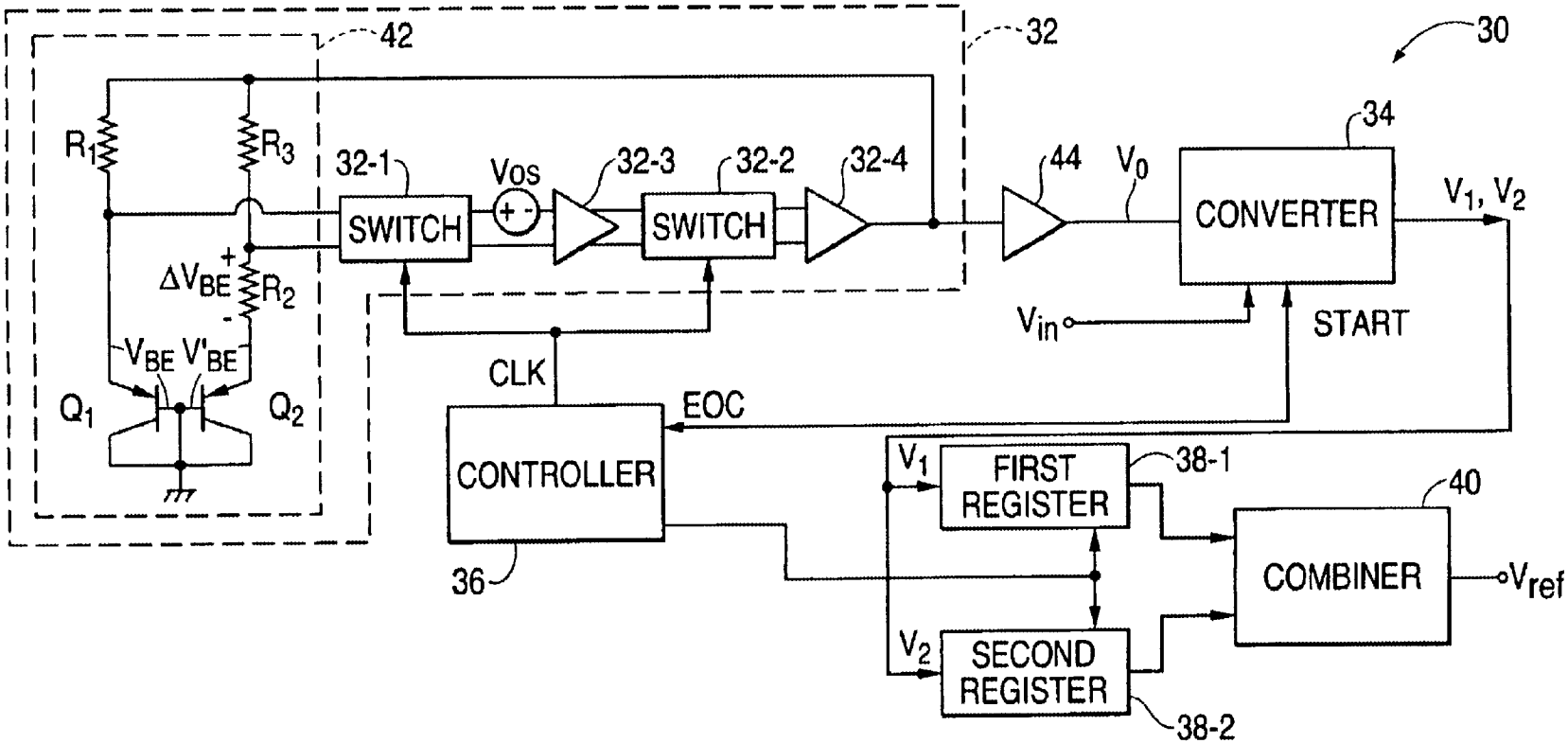
FIG. 2 shows a circuit diagram of a bandgap circuit in accordance with one embodiment of the present invention.

FIG. 2 shows a circuit diagram of a bandgap circuit 30 in accordance with one embodiment of the present invention. Referring to FIG. 2, bandgap circuit 30 includes a chopping circuit 32, a converter 34, a controller 36, a first register 38-1, a second register 38-2 and a combiner 40. Chopping circuit 32 includes a proportional-to-absolute-temperature (PTAT) circuit 42 that includes a first transistor $Q_1$, a second transistor $Q_2$, a first resistor $R_1$ coupled to an emitter (not numbered) of first transistor $Q_1$, a second resistor $R_2$ coupled at one end to an emitter (not numbered) of second transistor $Q_2$, and a third resistor $R_3$ coupled to the other end of second resistor $R_2$. One of transistors $Q_1$ and $Q_2$ has a greater collector area than the other. In one embodiment, second transistor $Q_2$ has a greater area than that of first transistor $Q_1$. Specifically, second transistor $Q_2$ has an area that is nth multiple of the area of first transistor $Q_1$, wherein n is greater than 1. In one embodiment, resistors $R_1$ and $R_3$ are approximately 20 KΩ, and resistor $R_2$ is approximately 2 kΩ.

PTAT circuit 42 provides a PTAT voltage ($\Delta V_{BE}$) across resistor $R_2$, the voltage of which is calculated as follows:

$$\Delta V_{BE}=V_T\times In(m)$$

if a first-order linearity is taken into consideration, and wherein $\Delta V_{BE}$ is the voltage difference between $V_{BE}$, a voltage across a base and an emitter of first transistor $Q_1$, and $\Delta V_{BE}'$, a voltage across a base and an emitter of second transistor $Q_2$, $V_T$ represents a threshold voltage of transistor $Q_1$ or $Q_2$, and m is the ratio between the size of transistors $Q_1$ and $Q_2$.

Chopping circuit 32 generally includes a first and second metal-oxide-semiconductor ("MOS") switches 32-1 and 32-2, and first and second amplifiers 32-3 and 32-4. An offset voltage ($V_{OS}$) may be formed in chopping circuit 32 due to asymmetric fabrication processes. Therefore, the output of chopping circuit 32 may be amplified by a third amplifier 44 to produce a voltage level ($V_0$) the level to which is calculated as follows:

$$V_0=V_{BE}+R_1/R_2\times[V_{OS}+V_T\times In(m)],\ \text{given that } R_1=R_3$$

Referring again to FIG. 2, converter 34 converts an input voltage ($V_{in}$) into a digital output based on voltage level $V_0$ in a predetermined period. In one embodiment, converter 34 is an analog-to-digital converter and provides an N-bit digital output in one the predetermined period. The predetermined period is generally the duration converter 34 requires to attain conversion.

Controller 36 issues a signal (START) to converter 34 to initiate a conversion action, and simultaneously provides a clock signal (CLK) to chopping circuit 32 to initiate a switching action. Once the conversion action is completed, converter 34 issues a signal (EOC) to controller 36 to indicate an end of the conversion process. Clock signal CLK has the same period as the predetermined period.

In operation, controller 36 synchronizes the switching action of chopping circuit 32 and the conversion action of converter 34. Controller 36 provides a first pulse of the clock to chopping circuit 32 and simultaneously a signal START signal to converter 34. Converter 34 generates a first output ($V_1$) during a first period, and sends a signal EOC to controller 36. In response to signal EOC, controller 36 issues another START signal to converter 34 and simultaneously provides a second pulse of the clock to chopping circuit 32. Converter 34 then generates a second output ($V_2$) in a second period after the first period. First output $V_1$ is a quantified value of $V_{in}/[(V_0+(R_1/R_2)V_{OS})/2^N]$, and second output $V_2$ is a quantified value of $V_{in}/[(V_0-(R_1/R_2)V_{os})/2^N]$. The values of $V_1$ and $V_2$ are different due to the existence of offset voltage $V_{OS}$.

First and second registers 38-1 and 38-2 respectively store first output $V_1$ and second output $V_2$. In response to a signal from controller 36, first and second registers 38-1 and 38-2 provide the stored first output V1 and second output $V_2$ to combiner 40. In one embodiment, combiner 40 includes an adder and a divider, and generates a reference voltage ($V_{ref}$) according to the following:

$$V_{ref}=2/(1/V_1+1V_2).$$

The present invention therefore also provides a method of generating a reference voltage. The method begins with generating a voltage level by using a chopping circuit. Subsequently, an input voltage is converted into a digital output based on the voltage level. A first output of the input voltage is generated in a predetermined period, and a second output of the input voltage is generated in a subsequent predetermined period. The method then provides a clock signal to the chopping circuit such that the chopping circuit generates the voltage level in the same period as the predetermined period. The first and the second outputs are combined to form a reference voltage.

In one embodiment, the clock generates a plurality of pulses, and the step of generating the first output includes generating the first output in every odd pulses, e.g., the first, third, and fifth pulses, and the step of generating the second output includes generating the second output in every even pulses, e.g., the second, fourth and sixth pulses.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A circuit for providing a reference voltage, comprising:

a chopping circuit for generating a voltage level;

a converter coupled to the chopping circuit for converting an input voltage into a digital output based on the voltage level, and generating a first output in a predetermined period, and a second output in a subsequent second predetermined period;

a controller for controlling the chopping circuit such that the chopping circuit generates the voltage level in a same period as the predetermined period;

a first register coupled to the converter for storing the first output;

a second register coupled to the converter for storing the second output; and a combiner for combining the first and the second outputs.

2. The circuit of claim 1, wherein the chopping circuit includes a proportional-to-absolute-temperature (PTAT) circuit for providing a PTAT voltage.

3. The circuit of claim 1, wherein the chopping circuit includes an offset voltage.

4. The circuit of claim 1, wherein the controller provides a clock signal having a same period as the predetermined period to the chopping circuit.

5. The circuit of claim 4, wherein the clock signal includes a plurality of pulses, and the converter generates the first output in every odd pulse, and generates the second output in every even pulse.

6. The circuit of claim 1, wherein the controller synchronizes the converter with the chopping circuit by providing a signal to initiate the converter.

7. The circuit of claim 1, wherein the combiner includes an adder and a divider.

8. A circuit for providing a reference voltage, comprising:

a chopping circuit for generating a voltage level ($V_0$);

an analog-to-digital converter coupled to the chopping circuit for converting an input voltage ($V_{in}$) into a digital out based on the voltage level, and generating a first output ($V_1$) of N bits in a first predetermined period, and a second output ($V_2$) of N bits in a subsequent second predetermined period;

a controller for synchronizing the chopping circuit and the converter by providing a clock to the chopping circuit and simultaneously a signal to initiate the converter such that the chopping circuit generates the voltage level in a same period as the predetermined period;

a first register coupled to the converter for storing the first output;

a second register coupled to the converter for storing the second output; and a combiner for combining the first and the second outputs and providing the reference voltage.

9. The circuit of claim 8, wherein the chopping circuit includes a proportional-to-absolute-temperature (PTAT) circuit comprising a first transistor having an emitter coupled to a resistor ($R_1$), and a second transistor having an emitter coupled to a different resistor ($R_2$).

10. The circuit of claim 8, wherein the chopping circuit includes metal-oxide-semiconductor switches.

11. The circuit of claim 9, wherein the chopping circuit includes an offset voltage ($V_{os}$).

12. The circuit of claim 8, wherein the clock signal having a same period as the predetermined period.

13. The circuit of claim 12, wherein the clock signal having a plurality of pulses, and the converter generates the first output in every odd pulses, and generates the second output in every even pulses.

14. The circuit of claim 11, wherein the first output is $V_{in}[(V_0+(R_1/R_2)V_{os})/2^N]$.

15. The circuit of claim 11, wherein the second output is $V_{in}/[(V_0-(R_1/R_2)V_{os})/2^N]$.

16. The circuit of claim 8, wherein the combiner generates a reference voltage having a value of $2/(1/V_1+1/V_2)$.

17. A method of providing a reference voltage, comprising:

providing a chopping circuit;

generating a voltage level through the chopping circuit;

converting an input voltage into a digital form based on the voltage level;

defining a first predetermined period;

defining a second predetermined period;

generating a first output of the input voltage in the first predetermined period;

generating a second output of the input voltage in the second predetermined period;

providing a clock to the chopping circuit;

generating the voltage level in a same period as the first predetermined period; and combining the first and the second outputs to form the reference voltage.

18. The method of claim 17, wherein the clock includes a same period as the first predetermined period.

19. The method of claim 18, wherein the clock generates a plurality of pulses, and wherein the step of generating the first output includes generating the first output in every odd pulses.

20. The method of claim 18, wherein the clock generates a plurality of pulses, and wherein the step of generating the second output includes generating the second output in every even pulses.

* * * * *

UNITED STATES PATENT AND TRADEMARK OFFICE

CERTIFICATE OF CORRECTION

PATENT NO. : 6,788,131 B1 
DATED : September 7, 2004
INVENTOR(S) : Te-Hsun Huang It is certified that error appears in the above-identified patent and that said Letters Patent is hereby corrected as shown below:

Column 5,
Line 33, "$V_{in}[(V_0+(R_1/R_2)V_{os)/}2^N]$" should read -- $V_{in}/[(V_0+(R_1/R_2)V_{os})/2^N]$ --.

Signed and Sealed this

Twenty-second Day of February, 2005

JON W. DUDAS
*Director of the United States Patent and Trademark Office*